US008448268B2

(12) United States Patent
Bradshaw

(10) Patent No.: US 8,448,268 B2
(45) Date of Patent: May 28, 2013

(54) POOL COVER HANGING ASSEMBLY

(76) Inventor: Michael Bradshaw, Jamestown, NY (US)

( * ) Notice: Subject to any disclaimer, the term of this patent is extended or adjusted under 35 U.S.C. 154(b) by 0 days.

(21) Appl. No.: 13/174,680

(22) Filed: Jun. 30, 2011

(65) Prior Publication Data

US 2013/0000030 A1 Jan. 3, 2013

(51) Int. Cl.
*E04H 4/00* (2006.01)

(52) U.S. Cl.
USPC ..... 4/500; 4/496; 211/182; 211/119.004; 211/100

(58) Field of Classification Search
USPC ..... 4/496, 598–503, 559; 211/182, 119.004, 211/118, 106.01, 99, 100; 248/225.21, 304, 248/226.11, 295.11, 500
See application file for complete search history.

(56) References Cited

U.S. PATENT DOCUMENTS 394,252 A * 12/1888 Davis ..... 248/291.1
3,707,007 A 12/1972 Trostler
4,234,973 A * 11/1980 Vetter et al. ..... 4/500
4,893,363 A * 1/1990 Huff ..... 4/496
5,068,928 A * 12/1991 Powell ..... 4/500
5,107,552 A 4/1992 Lavalliere et al.
5,371,907 A 12/1994 Horvath
5,593,122 A * 1/1997 Robertson et al. ..... 248/222.12
6,324,708 B1 * 12/2001 Langley ..... 4/559
6,487,734 B1 12/2002 First
6,913,385 B1 7/2005 Sagos
2008/0289094 A1 * 11/2008 Blom ..... 4/559

* cited by examiner

*Primary Examiner* — Huyen Le
*Assistant Examiner* — Erin Deery
(74) *Attorney, Agent, or Firm* — The Bilicki Law Firm, P.C.

(57) ABSTRACT

A pool cover hanging assembly includes a plurality of pool cover hanging devices. Each pool cover hanging device includes a rim engaging element including a pool wall abutting portion, a horizontally adjustable member coupled to the pool wall abutting portion at a first end, and a vertically adjustable connecting member coupled to the horizontally adjustable member. Each device also includes a vertically extending rod having a top end and a bottom end, the rod lying parallel to the exterior surface of the pool sidewall and being coupled at the top end to the vertical member of the rim engaging element. A rack arm is removably coupled to the vertically extending rod, wherein the removable rack arm is adapted to support a pool cover in a stored position.

20 Claims, 7 Drawing Sheets

POOL COVER HANGING ASSEMBLY

SUMMARY

Embodiments disclosed herein relate to an adjustable pool cover hanging assembly. The system comprises a pool surface and perimeter defined by pool sidewalls extending above ground. A flexible sheet member such as a solar blanket is adapted to cover the surface of the pool. An adjustable hanging device facilitates storage and removal of the flexible sheet from the pool surface and accommodates above ground pools in a range of perimeters and sidewall thicknesses.

Solar pool covers are an economical way to retain heat within swimming pool water year round, during early parts of pool season as well as during pool season when changes in weather patterns brought about by wind or precipitation can cause fluctuations in water temperature. Embodiments described herein therefore, utilize a solar blanket to maintain water temperature in order to minimize excessive costs associated with water heaters. Pool covers also prevent dirt and debris from contaminating water within the pool when the pool is not in use.

However, solar pool covers can be costly. In addition, failure to store a solar pool cover properly, can lead to additional costs associated with repair and/or replacement of the solar pool cover. Thus, the manner in which a pool cover is removed and subsequently stored may be important in terms of prolonging the useful life of the solar pool cover. Moreover, failure to hang a solar pool cover properly may pose a safety hazard in regard to slipping and falling. In addition, because solar pool covers are essentially comprised of many small solar cells with the function of attracting heat from the sun, solar pool covers inadvertently left on the ground or around pool areas may cause property damage including but not limited to burning of lawns and landscaping as well as costly damage to wooden pool deck structures.

Embodiments of a pool cover hanging device described herein demonstrate a device characterized by ease in installation and removal of the pool cover by one person both from inside and outside of the pool. This is due to the fact that the pool cover hanging device parts comprises very smooth surfaces, which guide the solar cover and prevent tearing. In addition, the pool hanging device of embodiments disclosed allows installation and removal of the device by one person without necessity of tools such as drills, hammers, wrenches, and the like. Embodiments of the pool hanging device can also accommodate varying pool dimensions and shapes.

DETAILED DESCRIPTION OF THE EMBODIMENTS

Figure 1:
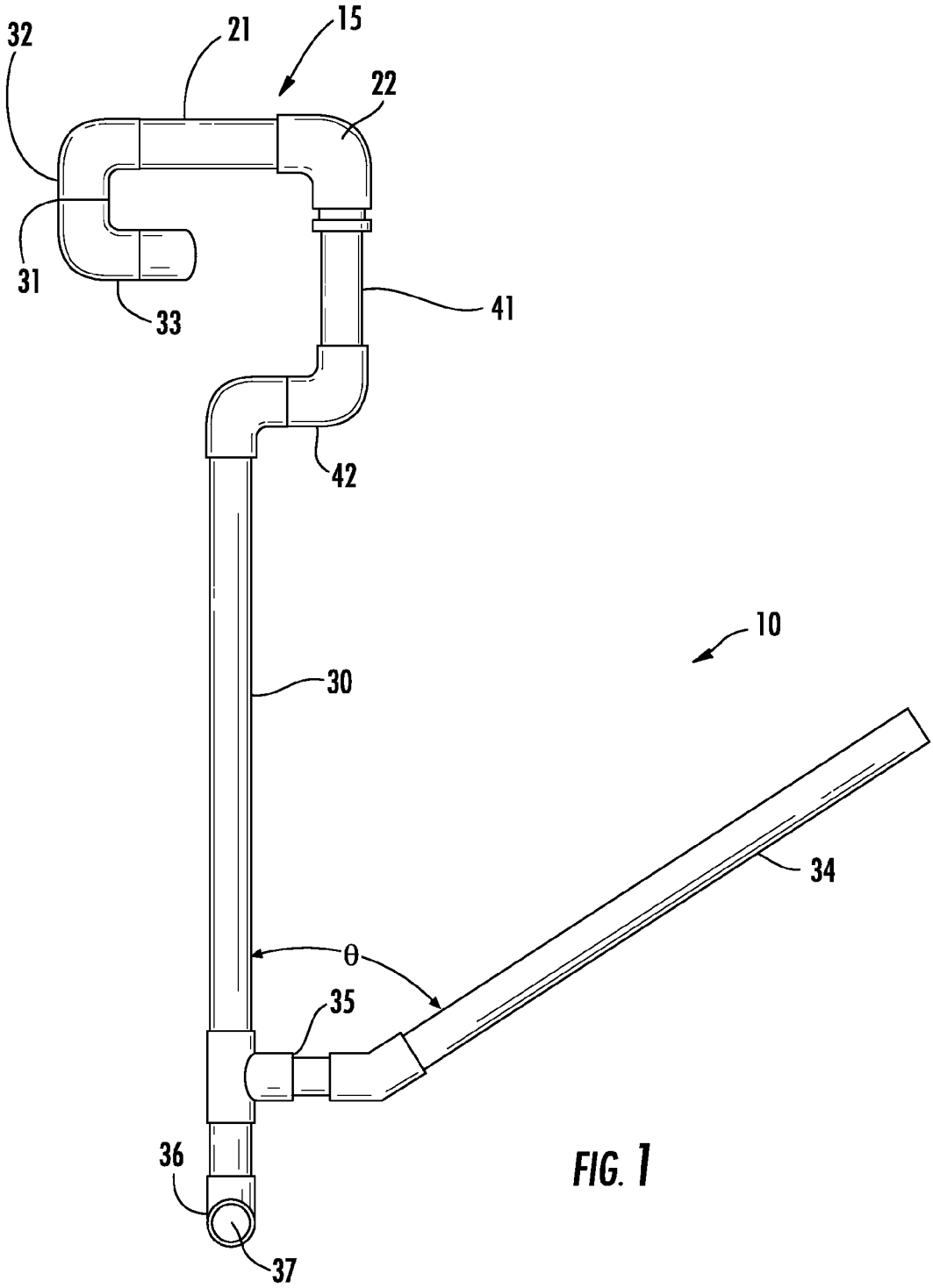
FIG. 1 shows a view of one embodiment of a single element pool cover hanging assembly associated with one embodiment.

For purpose of promoting an understanding embodiments disclosed herein, references are made to embodiments of a pool cover hanging assembly, and method of storing a flexible sheet member adapted to cover a surface of a pool, only some of which are illustrated in the drawings. It is nevertheless understood that no limitations to the scope of any embodiment disclosed herein is thereby intended. One of skill in the art will readily appreciate that modifications such as the types of materials utilized, positioning and dimensions of elements, etc. do not depart from the spirit and scope of embodiments disclosed herein. Some of these possible modifications are mentioned in the description which follows. Furthermore, in the embodiments depicted, like reference numerals refer to identical structural elements in the various drawings.

Figure 2:
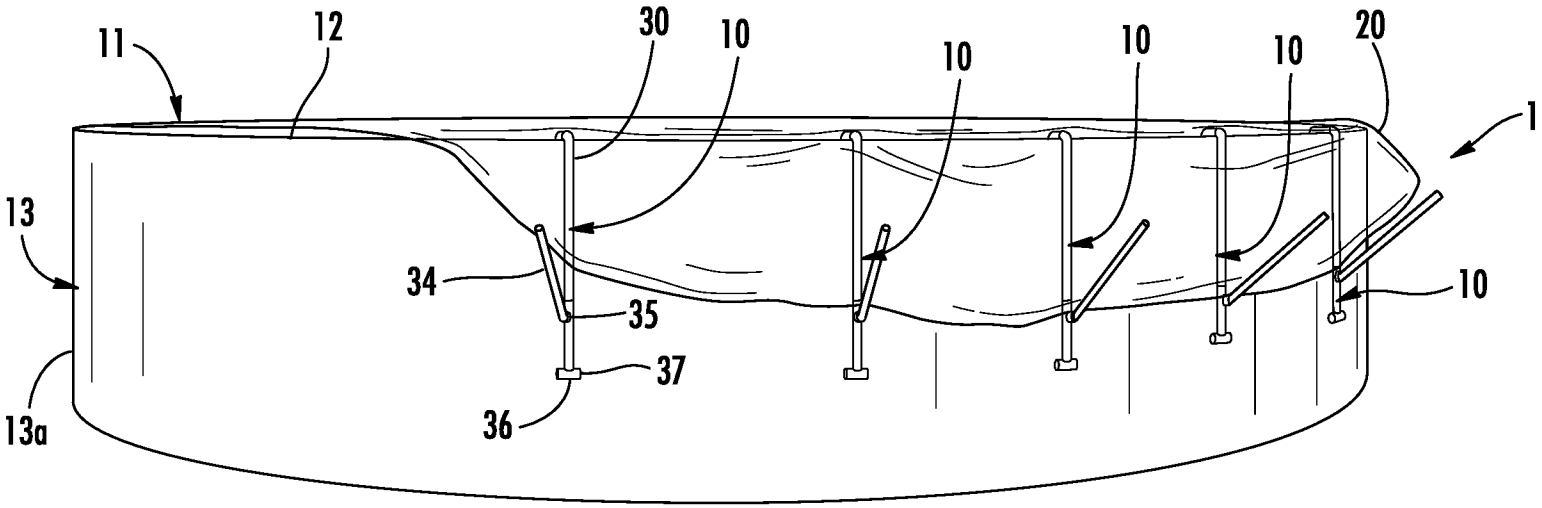
FIG. 2 shows an embodiment of an adjustable pool cover hanging assembly comprising a plurality of the pool cover hanging devices installed so as to extend from pool sidewalls at an angle θ in order to support a solar pool cover within the confines of each pool cover hanging device.

The pool cover hanging assembly 1 includes a plurality of pool cover hanging devices 10, one of which is shown in FIG. 1. Pool cover hanging device 10 includes a rim engaging element 15, which may be J-shaped, as shown in FIG. 1. Rim engaging element 15 includes a horizontally telescoping section 21, which is telescoping or otherwise adjustable in order to accommodate different sized pool rims or ledges. In addition, rim engaging element 15 includes a telescoping end 32 extending downwardly towards the pool interior. A pool wall abutting portion 33 extends from telescoping end 32 and abuts an inner surface 13*b* of the pool wall below a pool rim 60. Horizontally telescoping member 21 is connected to a telescoping connecting member 41 by a rotatable corner piece 22. An S-shaped telescoping portion 42 is attached to rim engaging portion 15 via telescoping connecting member 41. Rotation of rotatable corner piece 22 facilitates the rotation of telescoping connecting member 41 with respect to horizontally telescoping member 21. In addition rotation of telescoping connecting member 41 at rotatable corner piece 32 also causes the rotation of S-shaped telescoping portion 42 and vertically extending rod 30 with respect to horizontally telescoping member, by way of their connections to telescoping connecting member 41. A removable rack arm 34 is engageable with a vertically extending rod 30 via first receiving member 35. Vertically extending rod 30 is adapted to contact an outer surface 13*a* of pool 11. When rack arm 34 is engaged with first receiving member 35, rack arm 34 extends from the outer sidewall of the pool an acute angle θ as shown in FIG. 2. Angle θ may be between approximately 10 degrees and 60 degrees. In addition, a T-shaped stabilizer 36 is provided to enhanced stability and prevents rolling or twisting of pool cover hanging device 10. T-shaped stabilizer 36 also includes a second receiving member 37, as will be discussed in detail below.

FIG. 2 is a front view of an embodiment of the adjustable pool cover hanging assembly 1 disclosed herein. A pool 11 includes a top surface 12 and a perimeter defined by pool sidewalls 13 extending above ground, and having a predefined thickness. Sidewalls 13 may include inner and outer surfaces 13*a* and 13*b* having an internal thickness 14 therebetween. Also shown is a plurality of pool cover hanging devices 10 with flexible sheet 20 partially resting therein. In one embodiment, flexible sheet 20 may be, for example, a solar pool cover. In the embodiment shown, flexible sheet member 20 partially covers top surface 12 of pool 11 and is partially supported by rack arm 34 of the pool cover hanging device 10. Rack arm 34 is engaged with first receiving member 35 and extends from pool sidewalls 13 at an angle, such as acute angle θ. In the embodiment shown in FIG. 1, rack arm 34 is straight, but is coupled to an angled coupler 38 and an attachment piece 39, which directly engages first receiving member 35.

It will be appreciated by those skilled in the art that the dimensions of the pool shown in the drawings, particularly the height, position and thickness of as well as the total perimeter and side wall configuration of double or single wall construction will vary widely from one pool to another depending on the pool manufacturer. Pool cover hanging assembly 1 accommodates pools of varying dimensions with respect to sidewalls and top rims by way of horizontally telescoping member 21 and telescoping end 32 as well as telescoping connecting member 41. The adjustability of the disclosed pool cover hanging assembly 1 is discussed infra.

As discussed above, flexible sheet 20 may be a solar pool cover which may be formed of various polymeric materials including polyethylene, polyurethane, polyvinylchloride, and foam. The thickness of flexible sheet 20 ranges from 12 mil to 20 mil. Those of skill in the art will recognize that many different substances having a variety of dimensions and features may be utilized to manufacture the flexible sheet of the present invention in order optimize its capabilities as an exemplary pool cover.

Figure 3:
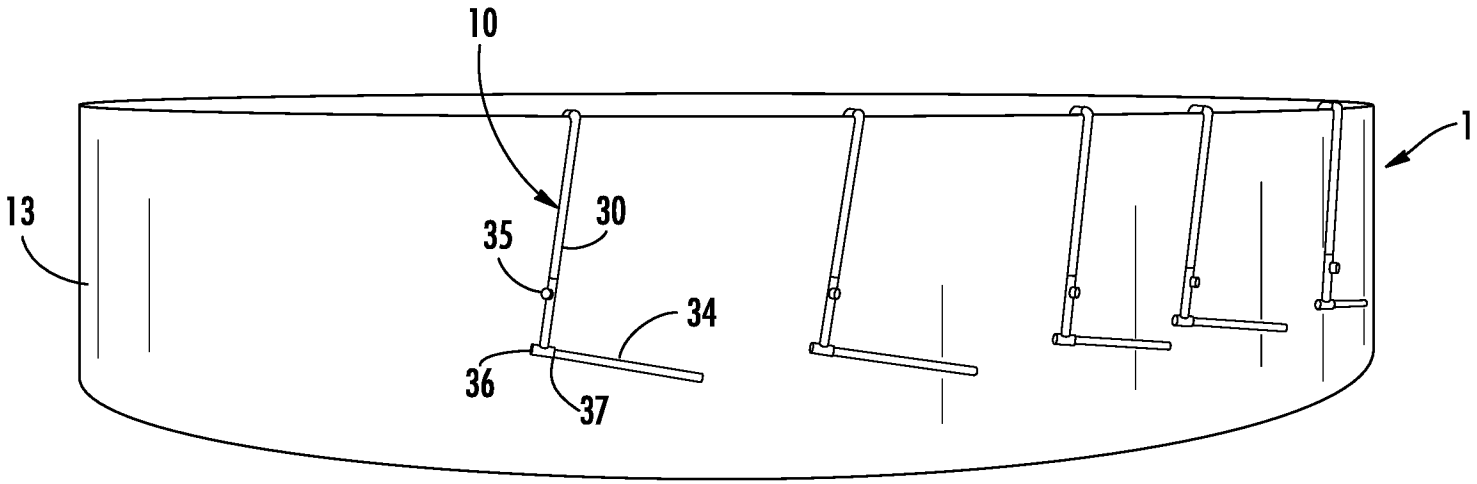
FIG. 3 is an alternative embodiment wherein a plurality of pool cover hanging devices associated with a pool cover hanging assembly are shown folded against sidewalls of a swimming pool during nonuse of the system.

As illustrated in FIG. 3, rack arm 34 may be placed in a stowed position by engaging second receiving member 37 instead of first receiving member 35 when not being used to support cover 20. When rack arm 34 is engaged with second receiving member 37, rack arm 34 is disposed so as to fold against pool sidewalls 13. In this embodiment, additional space is provided around pool 11 for activities including mowing, raking, or the like.

Figure 4:
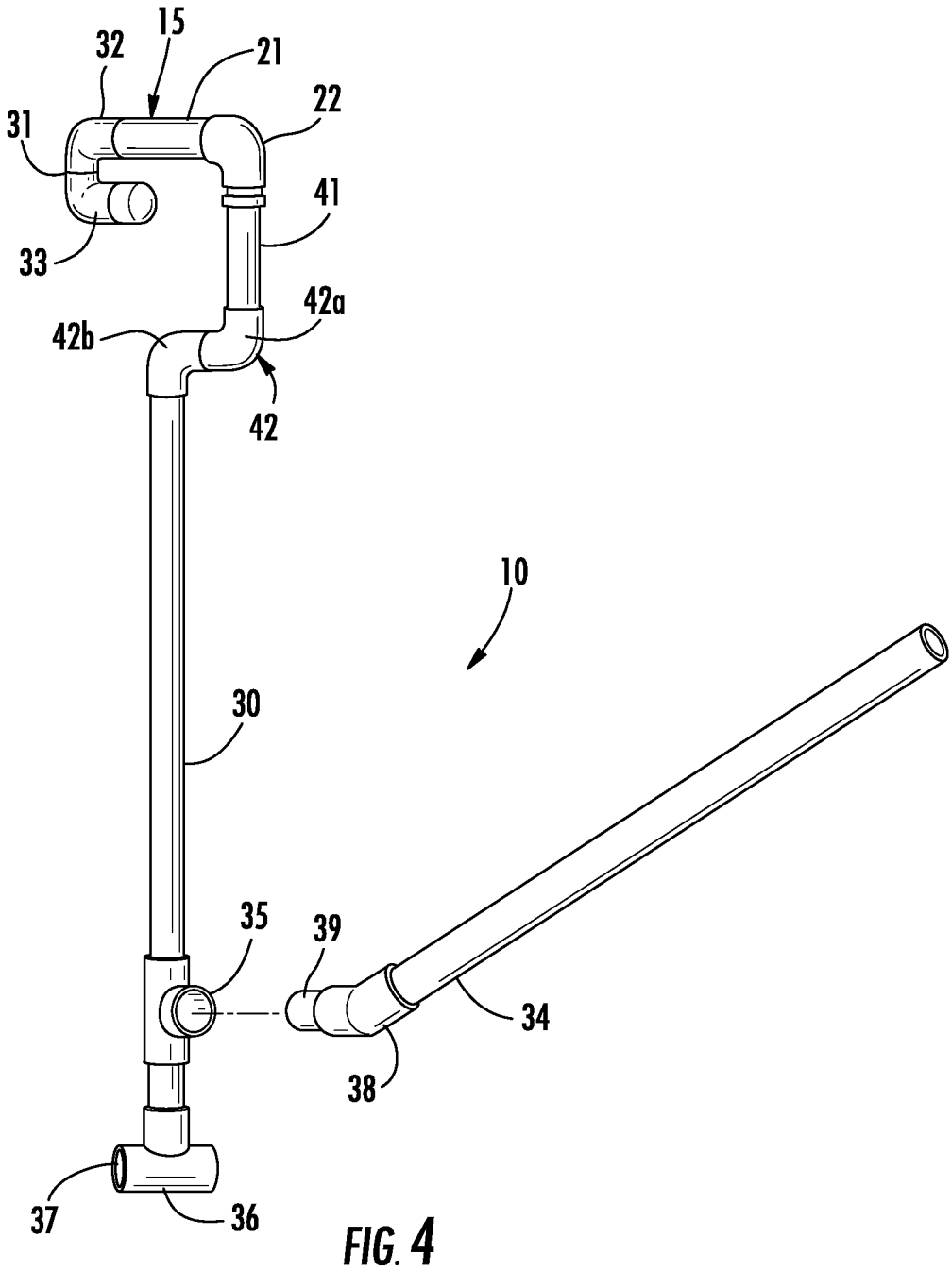
FIG. 4 shows another alternative embodiment wherein a rack arm associated with a pool cover hanging assembly is disassembled from the device during nonuse of the device.

FIG. 4 illustrates rack arm 34 removed from a pool cover hanging device 10 wherein rack arm 34 is removed from the device completely. As in the previous embodiment, removal of rack arm 34 provides additional space around pool 11 for activities such as mowing, raking, or the like. In addition, removal of rack arm 34 also aids in disassembling and storing the device.

Figure 5:
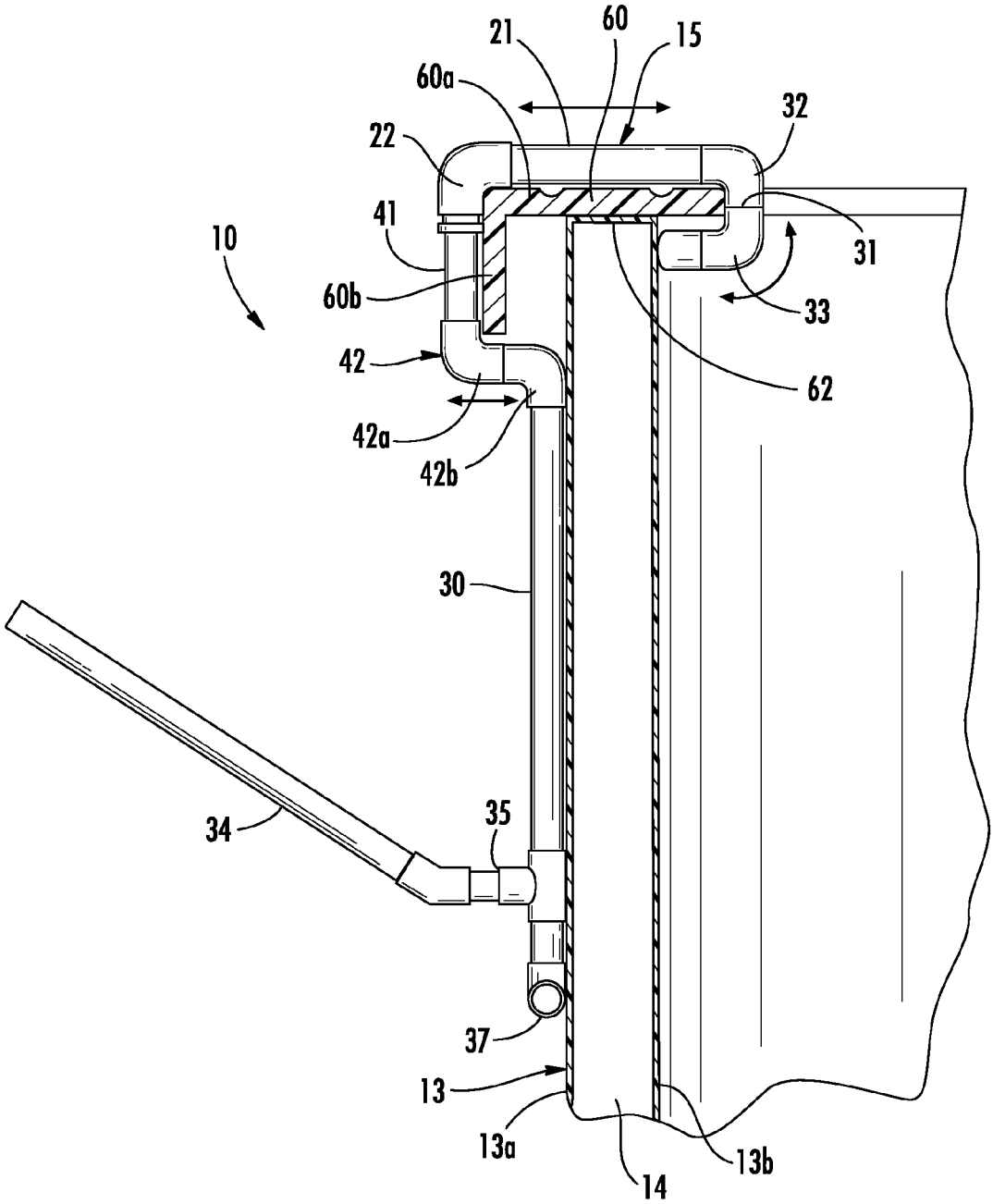
FIG. 5 shows a view of a pool cover hanging assembly in contact with a sidewall of a pool.

With respect to FIGS. 5-7, the operation of pool cover hanging assembly will be described. As discussed above, pools 11 typically include sidewalls 13 having inner and outer surfaces 13*a* and 13*b*. In addition, a rim 60, including a horizontal portion 60*a* and a vertical portion 60*b*, is often positioned over a top edge 62 of pool sidewalls 13. As illustrated, rim engaging element 15, includes horizontally telescoping member 21 which is adapted to expand or contract to accommodate pool rims 60 having horizontal pieces 60*a* of varying widths. Telescoping end 32 is coupled to horizontally telescoping member 21 at one end and pool wall abutting portion 33 at a rotatable joint 31. Rotatable joint 31 facilitates the secure attachment of rim engaging portion 15 onto pool rim 60. Thus, pool wall abutting portion 33 is rotatably connected to horizontally telescoping member 21 by way of rotatable joint 31 such that pool wall abutting portion 33 may be rotated outward for installation of pool cover hanging device 10 and rotated toward the inner pool wall 13*b* to secure device 10 to pool rim 60.

Telescoping connecting member 41 adjustably connects pool rim engaging portion 15 and S-shaped telescoping portion 42. In addition, telescoping connecting member 41 is capable of expanding and contracting to accommodate pools having rims 60 with varying sizes of vertical portions 60*b*. Similarly, S-shaped telescoping portion 42, which includes parts 42*a* and 42*b*, expands and contracts in order to ensure that vertically extending rod 30 rests securely against outer pool surface 13*a* and thus accommodates pool top rims 60 and sidewalls 13 of varying dimensions.

Figure 6:
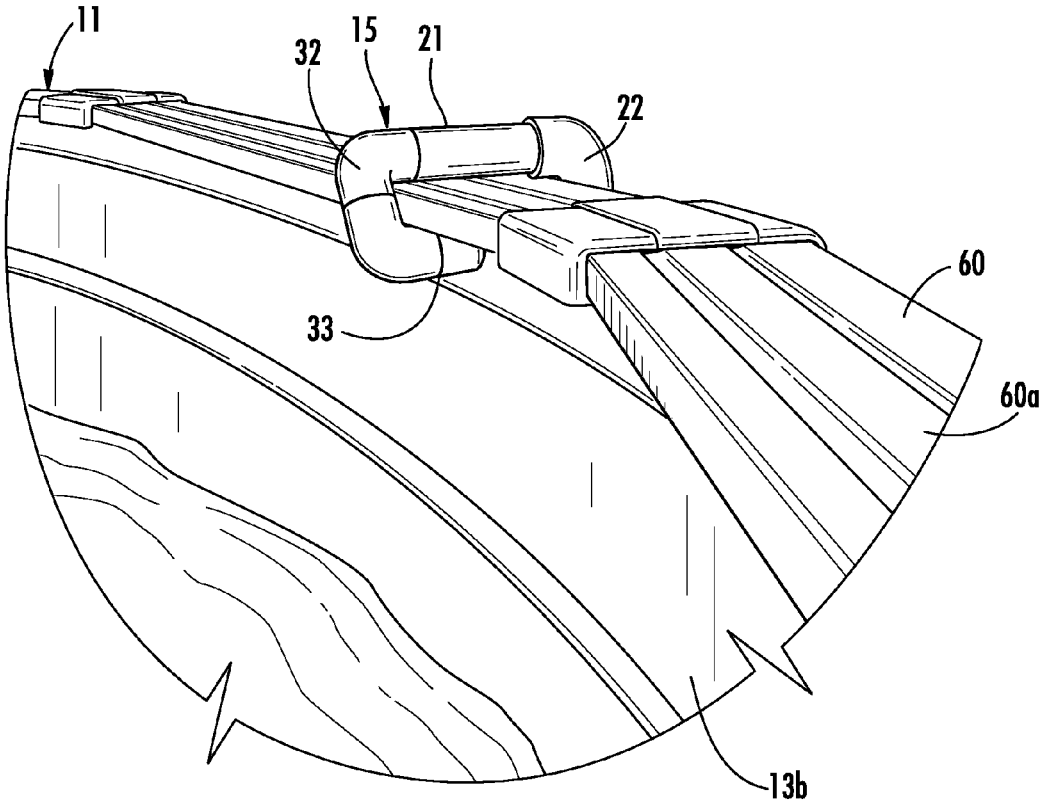
FIG. 6 shows an exploded view of a top portion of a pool cover hanging assembly of one embodiment.

FIG. 6 is a perspective view of pool cover hanging device 10 when attached to pool 11. Pool rim engaging portion 15 is shown with horizontally telescoping member 21 expanded to fit the width of horizontal portion 60*a* of pool rim 60. Telescoping end 32 is coupled to pool wall abutting portion 33 such that pool wall abutting portion 33 contacts inner surface 13*b* of pool sidewalls 13 in order to provide support to pool rim engaging portion 15. The adjustability of pool rim engaging portion eliminates the need for bolts or other cumbersome types of fasteners that make installation and removal of a typical pool cover hanging assembly 1 tedious. In addition, installation or removal of the disclosed pool cover hanging device 10 does not compromise pool sidewalls 13 because there is no need to drill holes into sidewalls 13, nor introduce bolts or other types of fasteners in order to hold the device in place. In addition, the adjustability of horizontally telescoping member 21, and the rotatability of telescoping end 32 and pool wall abutting portion 33, provides the capability to anchor pool cover hanging device 10 on pool top rims 60 by use of the force of gravity. Thus, the conformable nature of pool cover hanging device 10 by way of its adjustability, as well as the ability to maintain pool cover hanging device's 10 position on the pool without bolts, screws, pins, or nails, provides a pool cover hanging device 10 the ability to be used with many different swimming pools of varying sidewall dimensions without the need to compromise the structure of the actual pool.

Figure 7:
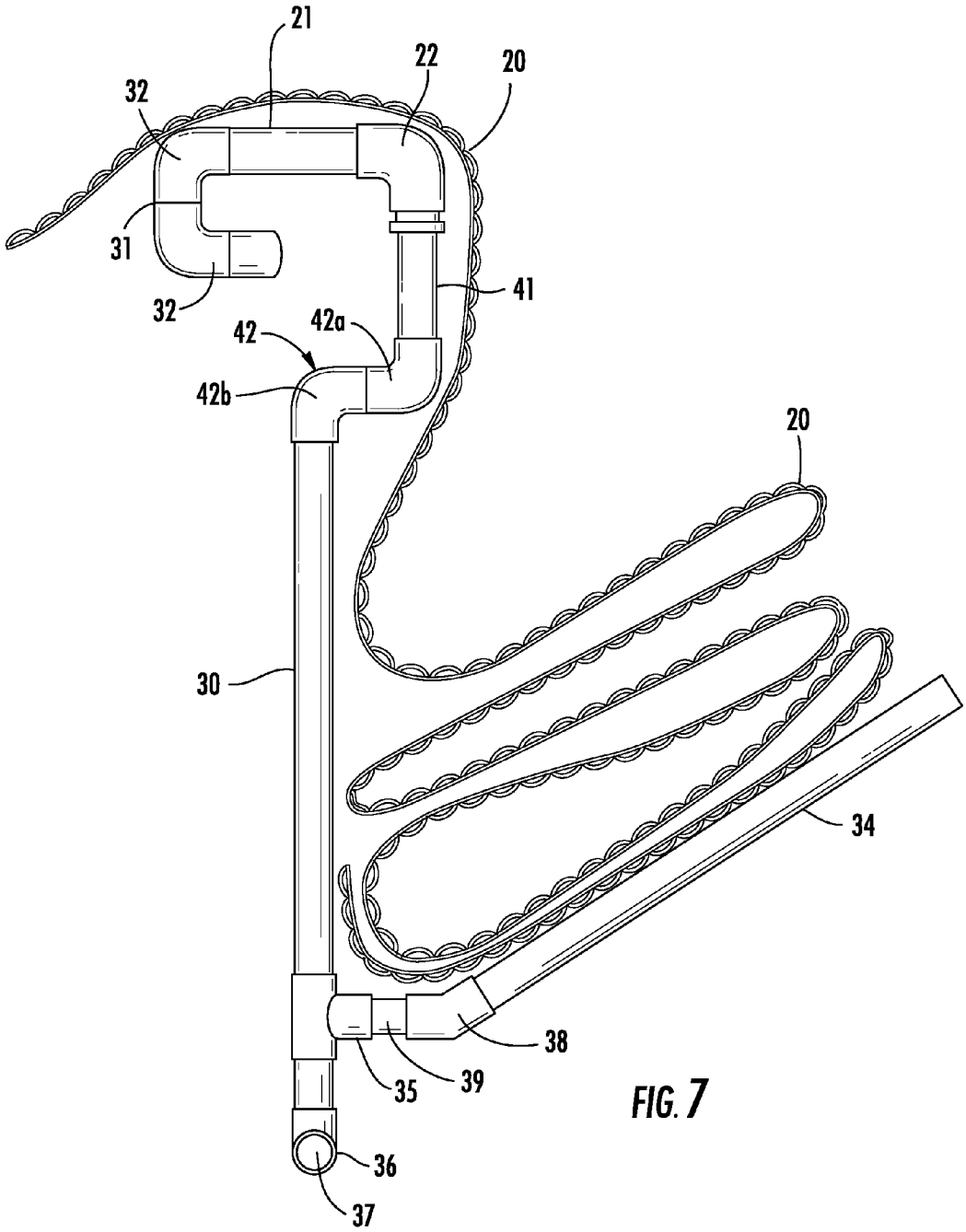
FIG. 7 illustrates a pool cover hanging assembly with a solar pool cover contained therein.

With respect to FIG. 7, pool cover 20 is stowed within pool cover hanging device 10. As described above, it should be understood that pool cover hanging device 10 is only one of two or more pool cover hanging devices 10 that make up the overall pool cover hanging assembly 1.

As will be described, the pool cover hanging assembly 1 disclosed extends the useful life of a solar pool cover in several ways. Solar pool covers contain solar cells, which aid in the transfer of heat derived from the sun to water contained in the pool, additionally solar pool covers aid in the retention of stored heat contained in the water by preventing heat loss due to wind or lower external temperatures. Thus, if these cells are damaged or compromised in any way, the solar pool cover does not perform this transfer of energy or heat retention in an efficient manner. In order to preserve the structure of these delicate solar cells, the pool cover hanging assembly 1 disclosed is made of a polymeric material which allows it to be manufactured with smooth, rounded, edges and surfaces. Thus, solar cover 20 gently glides over parts of the pool cover hanging assembly 1 and friction is minimized thus, preventing damage.

In addition, solar pool covers are also subject to damage due to continuous exposure to ultra violet radiation derived from the sun. Specifically, solar pool covers are typically made of polymeric materials. Polymeric/plastic materials react chemically with the sun's radiation, eventually breaking down the polymeric/plastic material. Moreover, the sun's radiation also produces heat. Heat accelerates the chemical deterioration brought about by ultra violet radiation. Many pool cover storage such as reel systems are made of metal or other highly thermally conductive material, which maximize heat and are in a permanent fixed position relative to the sun. However, the pool cover hanging assembly 1 disclosed in embodiments herein is made of a polymeric material, which is not a good thermal conductor. Additionally, the pool cover hanging assembly 1 disclosed in embodiments herein can be easily moved from the sun side of the pool to the shade side at different exposure times. Thus, the disclosed pool cover hanging assembly 1 also slows deterioration of solar pool cover 20 by minimizing heat-based wear and tear to its solar cells.

While embodiments of the present invention have been described hereinabove, it is to be understood that the subject matter encompassed by way of the claimed invention is not to be limited to such embodiments. On the contrary, it is intended for the scope of the claimed invention to include all alternatives, modifications and equivalents as can be included within the spirit and scope of the following claims.

I claim:

1. An adjustable pool cover hanging device for use with a pool having a perimeter defined by pool sidewalls, said pool sidewalls having interior and exterior surfaces and a top end with a rim, the adjustable pool cover hanging device comprising:

a rim engaging element comprising a horizontally adjustable member, a rotatable joint, an interior pool wall abutting portion pivotally coupled to the rotatable joint, and a rotatable corner piece, wherein both the rotatable joint and rotatable corner piece pivot relative to said pool sidewall and the horizontally adjustable member expands and contracts across the rim such that adjustment of said rotatable joint, rotatable corner piece, and horizontally adjustable member causes the rim engaging element to conform to the rim to thereby securely attach the adjustable pool cover hanging device to the rim;

a vertically adjustable connecting member coupled to said horizontally adjustable member by way of said rotatable corner piece;

a vertically extending rod having a top end and a bottom end, said rod lying parallel to and in contact with said exterior surface of the pool sidewall and being coupled at the top end to the vertically adjustable connecting member of the rim engaging element; and a rack arm removably coupled to the vertically extending rod, wherein the removable rack arm is adapted to support a pool cover in a stored position.

2. The adjustable pool cover hanging device of claim 1, wherein said vertically adjustable connecting member of the rim engaging element is a telescoping member.

3. The adjustable pool cover hanging device of claim 2 wherein said interior pool wall abutting portion is rotatably connected to the horizontally adjustable member such that the interior pool wall abutting portion may be rotated outward for installation of the pool cover hanging device and rotated toward the interior surface to secure the device to the sidewall such that said rim engaging element conforms to said rim.

4. The adjustable pool cover hanging device of claim 1, further including a second horizontally telescoping member positioned between the vertically adjustable connecting member and the vertically extending rod, said second horizontally telescoping member being adjustable such that the vertically extending rod may be positioned against the exterior surface of the pool sidewall.

5. The adjustable pool cover hanging device of claim 4, wherein said telescoping member and rotatable rim engaging element contact said rim.

6. The adjustable pool cover hanging device of claim 1, wherein a first receiving member connects said vertically extending rod and said removable rack arm such that said rack arm extends from said sidewall at an angle.

7. The adjustable pool cover hanging device of claim 6, wherein said removable rack arm extends from said sidewall at an acute angle of approximately 10 degrees to 60 degrees relative to said sidewall.

8. The adjustable pool cover hanging device of claim 6, wherein a second receiving member connects said vertically extending rod and said removable rack arm such that said rack arm is disposed folded against said sidewall.

9. The adjustable pool cover hanging device of claim 8, wherein said removable rack arm is removable from either of said first receiving member and second receiving member.

10. The adjustable pool cover hanging device of claim 1, wherein said pool cover hanging device comprises a material selected from group consisting of polymers, plastics, polyvinylchloride, and PVC.

11. The adjustable pool cover hanging device of claim 1, wherein said cover comprises a solar blanket.

12. The adjustable pool cover hanging device of claim 1, wherein said pool cover hanging device adjusts to accommodate variability in pool sidewall dimensions.

13. An adjustable pool cover hanging assembly for supporting a pool cover for a pool having a perimeter defined by pool sidewalls, said pool sidewalls having interior and exterior surfaces and a top end with a rim, said pool cover hanging assembly comprising:

a first pool cover hanging device positioned on the pool rim;

a second pool cover hanging device spaced apart from said first pool cover hanging device such that the pool cover is supported by both said first and second pool cover hanging devices, each of said first and second pool cover hanging devices comprising:

a rim engaging element comprising a horizontally adjustable member, a rotatable joint, an interior pool wall abutting portion pivotally coupled to the rotatable joint, and a rotatable corner piece, wherein both the rotatable joint and rotatable corner piece pivot relative to said pool sidewall and the horizontally adjustable member expands and contracts across the pool rim such that adjustment of said rotatable joint, rotatable corner piece, and horizontally adjustable member causes the rim engaging element to conform to the rim to thereby securely attach the pool cover hanging device to the rim;

a vertically adjustable connecting member coupled to said horizontally adjustable member by way of said rotatable corner piece;

a vertically extending rod having a top end and a bottom end, said rod lying parallel to and in contact with said exterior surface of the pool sidewall and being coupled at the top end to the vertically adjustable connecting member of the rim engaging element;

a second horizontally telescoping member positioned between the vertically adjustable connecting member and the vertically extending rod, said second horizontally telescoping member being adjustable such that the vertically extending rod may be positioned against the exterior surface of the pool sidewall; and a rack arm removably coupled to the vertically extending rod, wherein the removable rack arm is adapted to support a pool cover in a stored position.

14. The adjustable pool cover hanging device of claim 13, wherein-said vertically adjustable connecting member of the rim engaging element is a telescoping member.

15. The adjustable pool cover hanging assembly of claim 14 wherein said interior pool wall abutting portion is rotatably connected to the horizontally adjustable member such that the interior pool wall abutting portion may be rotated outward for installation of the pool cover hanging device and rotated toward the interior surface to secure the device to the sidewall such that said rim engaging element conforms to said rim.

16. The adjustable pool cover hanging device of claim 15, wherein a first receiving member connects said vertically extending rod and said removable rack arm such that said rack arm extends from said sidewall at an angle.

17. The adjustable pool cover hanging device of claim 16, wherein said removable arm extends from said sidewall at an acute angle of approximately 10 degrees to 60 degrees relative to said sidewall.

18. The adjustable pool cover hanging device of claim 13, wherein a second receiving member connects said vertically extending rod and said removable rack arm such that said rack arm is disposed folded against said sidewall.

19. The adjustable pool cover hanging device of claim 1, wherein said pool cover hanging device comprises a material selected from group consisting of polymers, plastics, polyvinylchloride, and PVC.

20. A method of installing a pool cover hanging assembly adapted to support a flexible cover for covering a surface of a pool, said pool surface defined by pool sidewalls extending above ground, said sidewalls comprising a top end with a pool rim, and a bottom end, wherein two or more pool cover hanging devices are engaged with said sidewalls in order to support said flexible cover, said method comprising the steps of:

determining an optimum number of pool cover hanging devices based on a perimeter of said pool and a weight of said cover;

placing said two or more hanging devices on said pool perimeter;

adjusting each pool cover hanging device;

wherein adjusting each of said pool cover hanging devices comprises:

attaching a rim engaging element to said pool rim by adjusting horizontally adjustable member to a width of the pool rim, pivoting a rotatable joint and an interior pool wall abutting portion with respect to an interior pool wall, and rotating a rotatable corner piece and vertically adjustable member with respect to an exterior surface of the pool sidewall, wherein adjustment of said rotatable joint, rotatable corner piece, and horizontally adjustable member causes the rim engaging element to conform to the pool rim to thereby securely attach the adjustable pool cover hanging device to the pool rim;

positioning a vertically extending rod having a top end and a bottom end, said rod lying parallel to and in contact with said exterior surface of the pool sidewall and being coupled at the top end to the vertically adjustable connecting member;

adjusting a second horizontally telescoping member positioned between the vertically adjustable connecting member and the vertically extending rod such that the vertically extending rod is positioned against the exterior surface of the pool sidewall; and positioning a rack arm removably coupled to the vertically extending rod, wherein the removable rack arm is adapted to support a pool cover in a stored position.

* * * * *